US008648779B2

(12) United States Patent
Hsueh et al.

(10) Patent No.: US 8,648,779 B2
(45) Date of Patent: Feb. 11, 2014

(54) LCD DRIVER

(75) Inventors: Fu-Lung Hsueh, Cranbury, NJ (US); Yung-Chow Peng, Hsinchu (TW); Kuo-Liang Deng, Miaoli (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 635 days.

(21) Appl. No.: 12/582,107

(22) Filed: Oct. 20, 2009

(65) Prior Publication Data

US 2011/0090198 A1 Apr. 21, 2011

(51) Int. Cl.
*G09G 5/00* (2006.01)
*G09G 3/36* (2006.01)

(52) U.S. Cl.
USPC ..... 345/87; 345/211

(58) Field of Classification Search
None
See application file for complete search history.

(56) References Cited

U.S. PATENT DOCUMENTS

| | | | | |
|---|---|---|---|---|
| 5,162,801 | A | 11/1992 | Powell et al. | |
| 6,191,779 | B1 * | 2/2001 | Taguchi et al. | 345/204 |
| 6,570,519 | B1 | 5/2003 | Yang | |
| 7,355,582 | B1 | 4/2008 | Bell | |
| 7,592,940 | B2 | 9/2009 | Sung | |
| 7,855,720 | B2 | 12/2010 | Yoshioka et al. | |
| 7,940,243 | B2 | 5/2011 | Woo et al. | |
| 2002/0021267 | A1 * | 2/2002 | Walker et al. | 345/76 |
| 2008/0030390 | A1 * | 2/2008 | Jeon et al. | 341/144 |
| 2008/0030489 | A1 * | 2/2008 | Kim et al. | 345/205 |
| 2009/0195533 | A1 * | 8/2009 | Chen et al. | 345/214 |

FOREIGN PATENT DOCUMENTS

| | | | |
|---|---|---|---|
| CN | 1193223 | A | 9/1998 |
| JP | 1059533 | A | 3/1989 |
| JP | 2005-537749 | | 12/2005 |
| JP | 2008-034955 | A | 2/2008 |
| JP | 2008-160838 | A | 7/2008 |
| KR | 10-2006-0070709 | | 6/2006 |
| KR | 10-2006-0130231 | | 12/2006 |
| KR | 1020080012070 | | 2/2008 |
| TW | 200836490 | | 12/1996 |
| TW | 200638685 | | 11/2006 |
| WO | 2004021251 | A2 | 3/2004 |

OTHER PUBLICATIONS

Chih-Wen Lu and Lung-Chien Huang, "A 10-Bit LCD Column Driver with Piecewise Linear Digital-to-Analog Converters," IEEE Journal of Solid-State Circuits, vol. 43, No. 2, Feb. 2008, pp. 371-378.

(Continued)

*Primary Examiner* — Joseph Haley
*Assistant Examiner* — Emily Frank
(74) *Attorney, Agent, or Firm* — Duane Morris LLP

(57) ABSTRACT

A method includes outputting a first signal from a first DAC decoder circuit in response to receiving a first number of bits of a digital control signal, outputting a second signal from a second DAC decoder circuit in response to receiving a second number of bits of the digital control signal, and alternately outputting one of the first and second signals to an LCD column from a buffer coupled to the first and second DAC decoder circuits. The first signal has a voltage level equal to one of a first plurality of voltage levels received at one of a first plurality of inputs of the first DAC decoder circuit. The second signal has a voltage level equal to one of a second plurality of voltage levels received at one of a second plurality of inputs of the second DAC decoder circuit.

16 Claims, 8 Drawing Sheets

(56) References Cited

OTHER PUBLICATIONS

Bell, M., "An LCD Column Driver Using a Switch Capacitor DAC", IEEE Journal of Solid-State Circuits, 2005, 40 (12):2756-2765.
Official Action issued Dec. 19, 2011 in counterpart Korean patent application.
English translation of Official Action issued Jun. 13, 2012, in counterpart Japanese Patent Application No. 2010-235087.
Official Action issued Jun. 13, 2012, in counterpart Japanese Patent Application No. 2010-235087.
Official Action issued Feb. 5, 2013, in counterpart Chinese Patent Application No. 201010237434.5.
Notice of Allowance issued May 14, 2013, in counterpart Taiwan Patent Application No. 10-2010-0077992.
Official Action issued Oct. 29, 2013 in counterpart Taiwan Patent Application, including Search Report.
Tuthill, M., "A Switched-Current, Switched-Capacitor Temperature Sensor in 0.6 μm CMOS", IEEE Journal of Solid-State Circuits, Jul. 1998, 33(7):1117-1122.
Gregorian, R., et al., "Switched-Capacitor Circuit Design", Proceedings of the IEEE, Aug. 1983, 71(8):941-966.

* cited by examiner

LCD DRIVER

FIELD OF DISCLOSURE

The disclosed systems and methods relate to liquid crystal displays (LCDs). More specifically, the disclosed systems and methods relate to panel drivers for LCDs.

BACKGROUND

LCD televisions (LCDTVs) are rapidly evolving creating high definition displays with more colors and resolution. Accordingly, the signal processing capabilities of LCDTVs have become increasingly more complex in order to properly process multi-bit television signals. The driver system of an LCDTV typically includes column drivers, row drivers, a timing controller, and a reference source comprising a resistor string (R-string) digital-to-analog converter (DAC) supplying voltage levels for the multi-bit resolution.

The column drivers process ten-bit digital input codes and convert them to analog levels. Although the digital input codes are ten-bits, an additional bit is typically used to drive the backside electrodes of the LCD displays with an alternating polarity. An additional DAC, a negative DAC (NDAC), is also provided as a negative reference source. To perform the requisite data conversion, a column driver for each channel of the LCD panel typically includes shift registers 102, input registers 104, data latches 106, level shifters 108, DAC decoders 110, and output buffers 112 as illustrated in FIG. 1.

Digital display data (e.g., RGB inputs) are sampled into the input registers 104 as controlled by the clock, CLK, which is applied to the shift registers 102. The data latches 106 receive one row of serial input pixel data, which they output to the level shifters 108. Level shifters 108 increase the signal power from a low-voltage signal to a high-voltage signal. The DAC decoders 110 receive the high-voltage signal, which is usually a multi-bit digital input code, and outputs a voltage level corresponding to the digital input code through buffers 112 to the highly capacitive data lines of the LCD panel.

The DAC decoders 110 take up the most area as they require a plurality of switches to decode the 10-bit input code. FIG. 2 illustrates one example of a positive DAC (PDAC) decoder 200 and a negative DAC (NDAC) decoder respectively coupled to a PDAC and an NDAC of an LCD panel. A ten-bit digital input code requires 1024 different voltage levels (e.g., 2^10=1024) and thus each channel will require 2048 different signal lines to connect the PDAC and NDAC decoders of a single channel to the PDAC and NDAC of the LCD panel. Accordingly, the metal lines and DAC decoders occupy a large amount of space on the integrated circuit for the LCD panel driver.

One attempt at reducing the overall size of a column driver is disclosed by Chih-Wen Lu and Lung-Chien Huang in "A 10-bit LCD Column Driver with Piecewise Linear Digital-to-Analog Converters", IEEE Journal of Solid-State Circuit, Vol. 43, No. 2, February 2008, pgs 371-78, the entirety of which is herein incorporated by reference in its entirety. The Lu et al. article discloses a seven bit resistor string DAC (R-DAC) decoder and a three bit charge sharing DAC (C-DAC) decoder. The voltages for the R-DAC decoders are received from a single resistor string. The data conversion performed by the R-DAC decoders are used by the C-DACs. However, the C-DACs are not directly coupled to a common reference point increasing the chances of a mismatch occurring between adjacent channels which in turn may reduce the resolution of the LCD display device.

Accordingly, an improved architecture for an LCD driver is desirable.

SUMMARY

In some embodiments, a circuit includes a first digital-to-analog converter (DAC) decoder circuit having a first plurality of inputs, a second DAC decoder circuit having a second plurality of inputs, and a buffer having a first input configured to receive an output of the first DAC decoder circuit and a second input configured to receive an output of the second DAC decoder circuit. Each of the plurality of inputs of the first DAC decoder circuit is coupled to a respective output of a first DAC. The first DAC decoder circuit is configured to receive a first number of bits of a digital control signal and output a first output signal in response. The first output signal has a first voltage level corresponding to a voltage level received at one of the plurality of inputs of the first DAC decoder circuit. Each of the second plurality of inputs of the second DAC decoder circuit is coupled to a respective output of a second DAC. The second DAC decoder circuit is configured to receive a second number of bits of the digital control signal and output a second output signal in response. The second output signal has a second voltage level corresponding to a voltage level received at one of the second plurality of inputs of the second DAC decoder circuit. The buffer is configured to output a third output signal having a voltage level based on one of the first and second voltage levels received from the outputs of the first and second DAC decoder circuits.

In some embodiments, a method includes outputting a first signal from a first DAC decoder circuit in response to receiving a first number of bits of a digital control signal, outputting a second signal from a second DAC decoder circuit in response to receiving a second number of bits of the digital control signal, and alternately outputting one of the first and second signals to an LCD column from a buffer coupled to the outputs of the first and second DAC decoder circuits. The first signal has a voltage level equal to one of a first plurality of voltage levels received at one of a first plurality of inputs of the first DAC decoder circuit. The second signal has a voltage level equal to one of a second plurality of voltage levels received at one of a second plurality of inputs of the second DAC decoder circuit.

DETAILED DESCRIPTION

The improved LCD source driver architecture described below provides a time averaged voltage to an LCD column enabling the overall size of the LCD column driver to be reduced compared to conventional LCD drivers while at the same time maintaining the multi-bit resolution. The improved LCD source driver receives references voltages from first and second PDACs and NDACs. Each channel of the LCD panel includes first and second DAC decoders that have their outputs coupled together to provide a time-averaged signal to the LCD column. The method in which the signals are time averaged together may be varied to improve the brightness output by the display. Additionally, the bit resolution of the first and second DAC decoders may be varied along with the bit resolution of the DACs depending on the process variations in fabricating the integrated circuit (IC) as described below.

Figure 1:
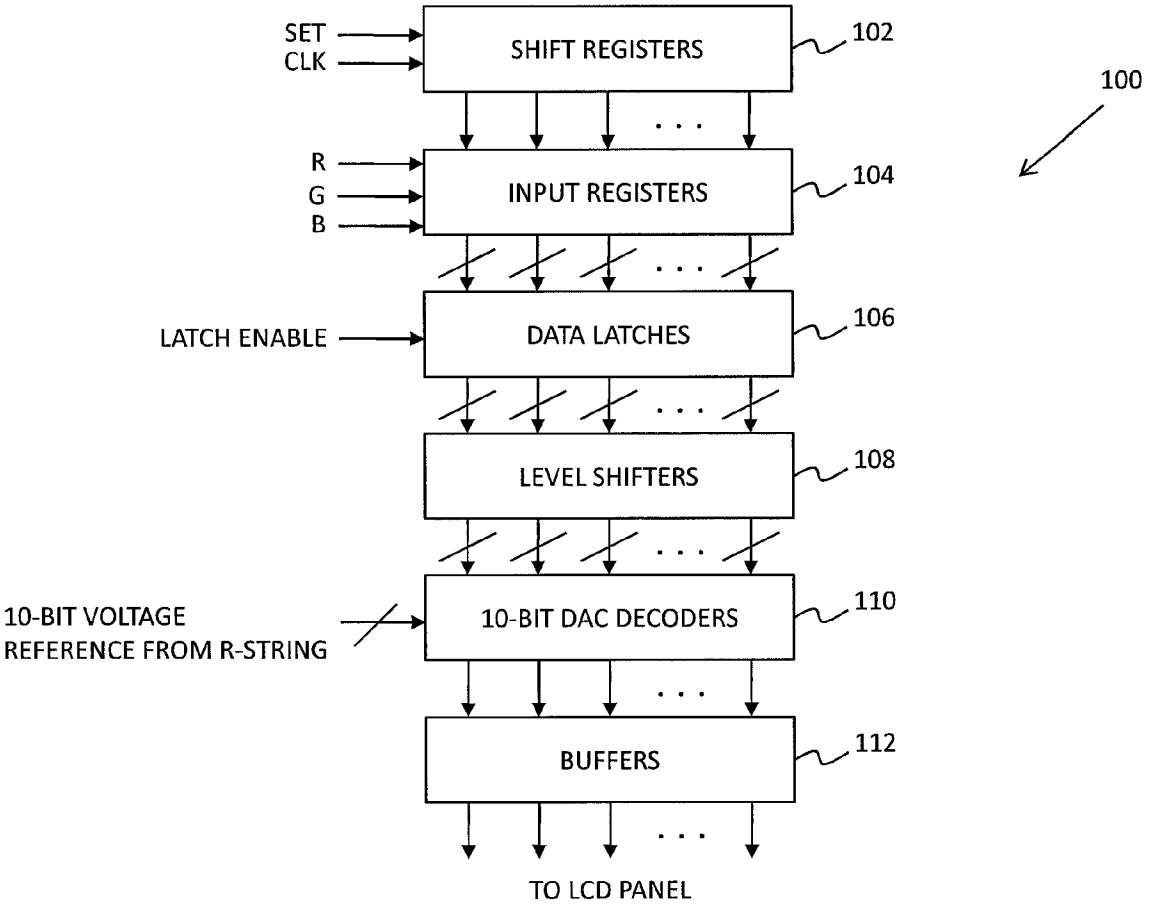
FIG. 1 (PRIOR ART)
FIG. 1 is a block diagram of a conventional architecture of an LCD driver.
Figure 2:
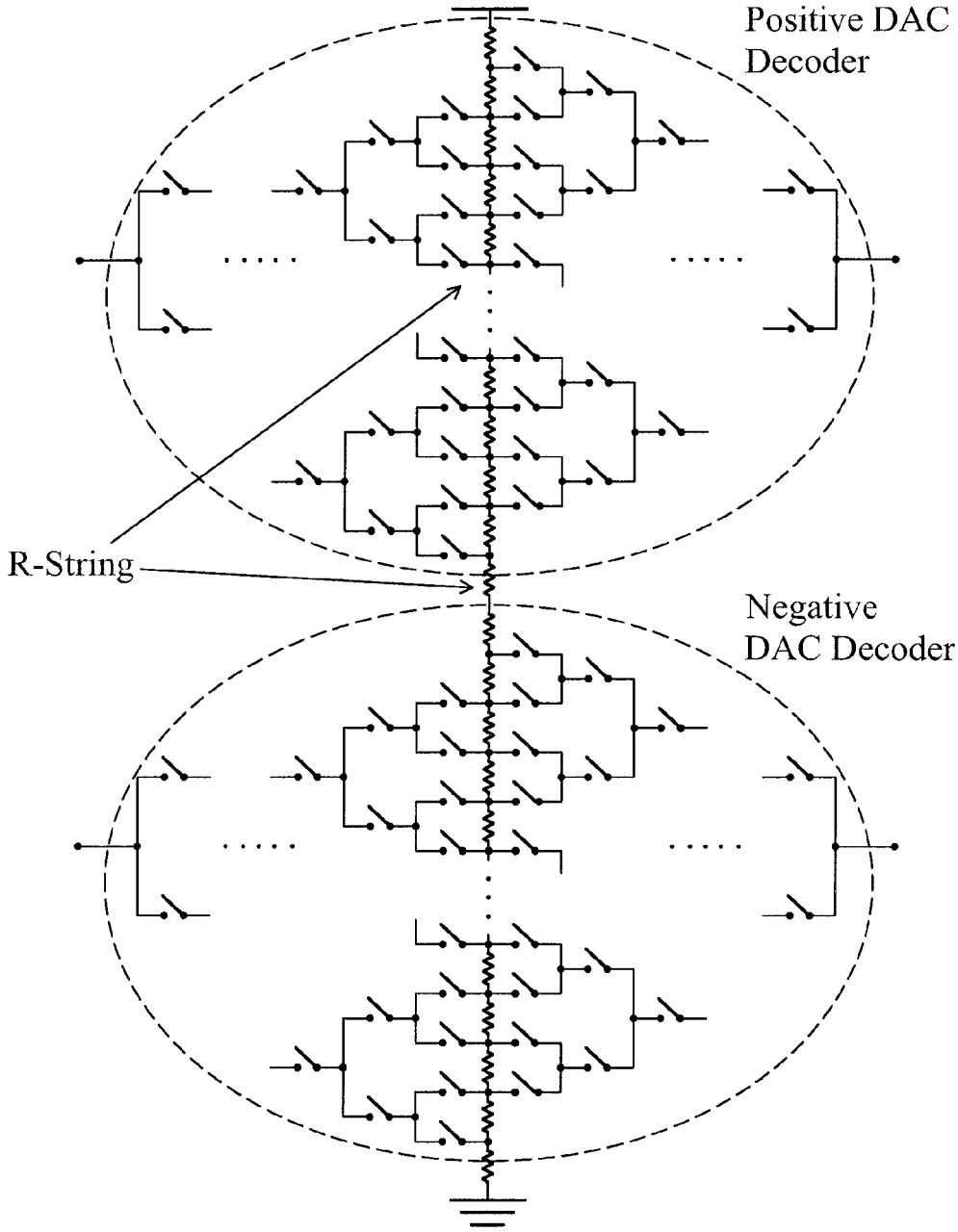
FIG. 2 ( PRIOR ART )
FIG. 2 illustrates a DAC decoder coupled to a PDAC and an NDAC.
Figure 3:
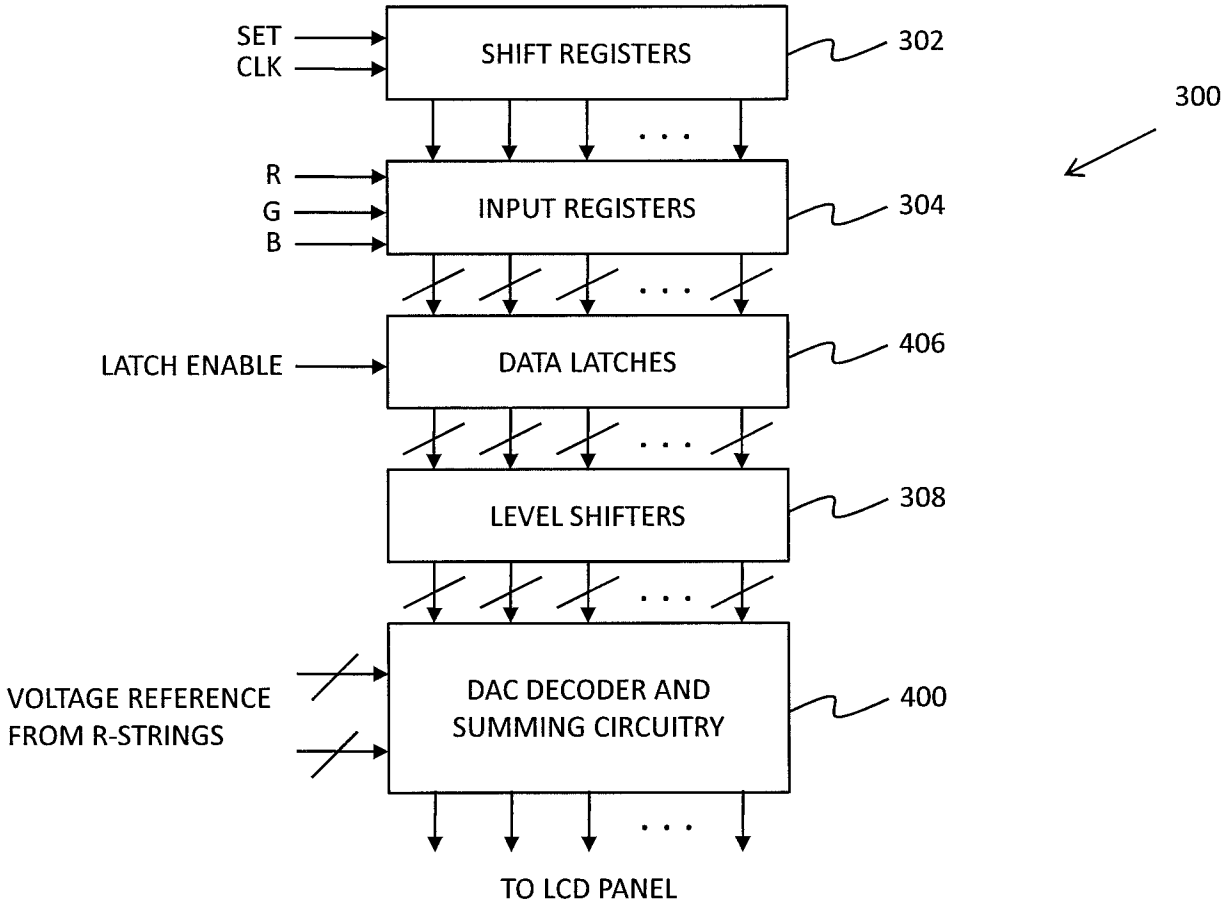
FIG. 3 is a block diagram of one example of an improved LCD driver architecture.

FIG. 3 is a block diagram of an improved LCD column driver 300. As shown in FIG. 3, LCD column driver includes shift registers 302, input registers 304, data latches 306, level shifters 308, and DAC decoder and summing circuitry 400. The DAC decoder and summing circuitry 400 receives the reference voltages from the first and second DACs, which may be implemented as R-string (sometimes referred to as R-ladders) as will be understood by one skilled in the art.

Figure 4A:
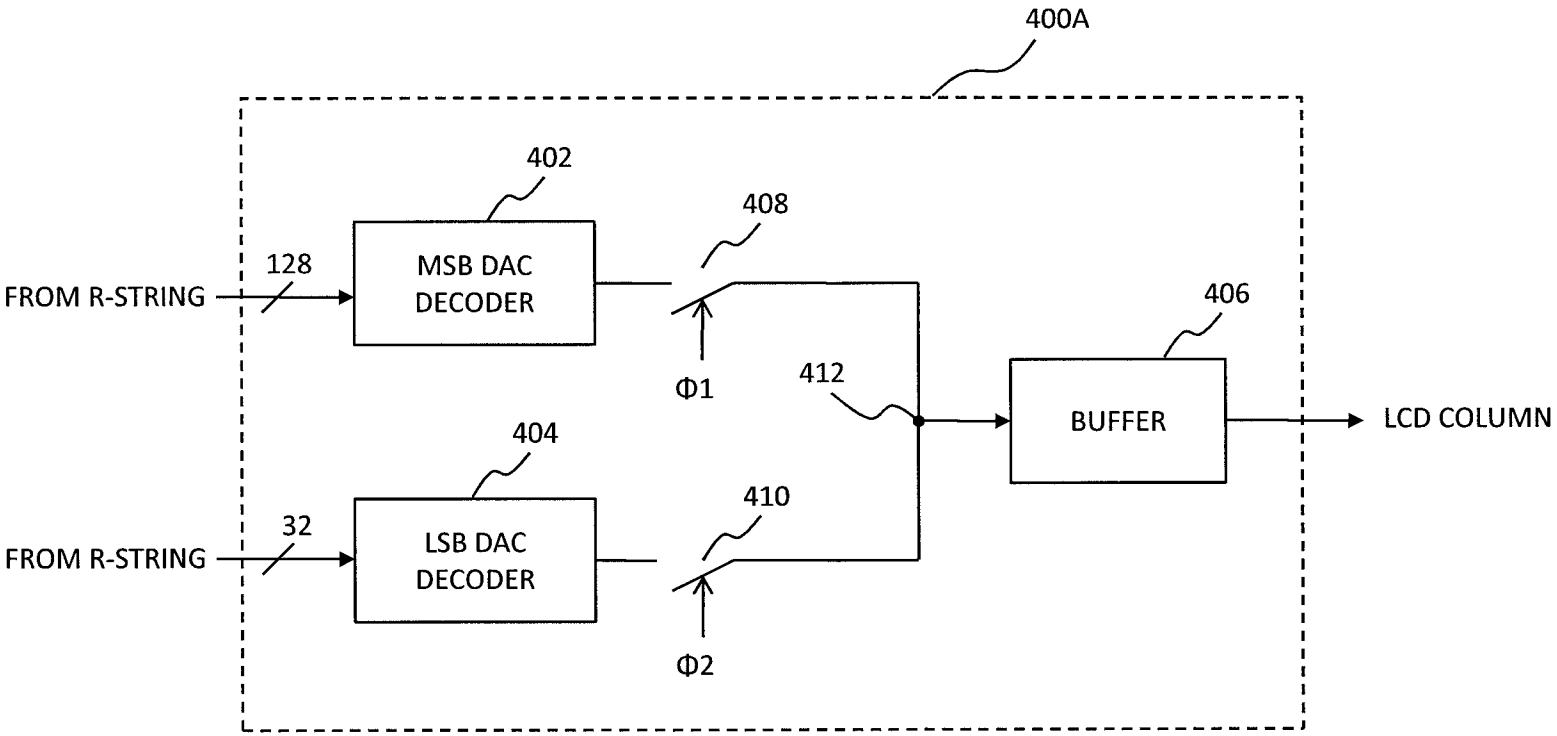
FIG. 4A illustrates one example of DAC decoder and summing circuitry in accordance with FIG. 3.

FIG. 4A illustrates one example of DAC decoder and summing circuitry 400A. As shown in FIG. 4A, the DAC decoder and summing circuitry 400A includes a most-significant bit (MSB) DAC decoder 402 and an least-significant bit (LSB) DAC decoder 404. The MSB DAC decoder 402 and LSB DAC decoder 404 are coupled together at node 412 through switches 408 and 410, respectively. Node 412 is also coupled to an input of a buffer 406, which may be a unity gain buffer implemented using an operational amplifier (opamp) as will be understood by one skilled in the art.

In some embodiments, the MSB DAC decoder 402 is configured to decode the six MSBs of a 10-bit digital input code and output a corresponding voltage. As shown in FIG. 4A, the MSB DAC decoder 402 receives 64 voltage levels from an R-string PDAC having six-bit resolution and another 64 voltage levels from an R-string NDAC having six-bit resolution for a total of 128 voltage levels each received on a separate conductor line. The LSB DAC decoder 404 receives 16 voltage levels from an R-string PDAC having four-bit resolution and another 16 voltage levels from an R-string NDAC also having four-bit resolution for a total of 32 voltage levels. Accordingly, 160 conductive lines are used to connect the DAC decoder and summing circuitry 400A to the two PDACs and two NDACs compared to the 2048 lines required to connect a conventional DAC decoder to a ten-bit R-string PDAC and a ten-bit R-string NDAC.

Advantageously, the LSB DAC decoder 404 may be implemented using low power devices as it will receive relatively low voltage levels (e.g., less than five volts) from its respective DAC due to the fact that the MSB DAC decoder 402 decodes the MSBs of the digital input signal, which correspond to higher voltage levels (e.g., greater than five volts). For example, if the LCD display is powered with approximately 20 volts and the MSB DAC decoder receives the six MSBs of a ten-bit digital input code, then the MSB DAC decoder 402 receives 64 different voltage levels ranging from zero volts to twenty volts from the DAC to which it is connected. Thus, the voltage levels received by the MSB DAC decoder 402 differ by approximately 0.3 volts from each other (e.g., 20 volts divided by 64 different voltage levels). Accordingly, the LSBs correspond to voltages less than 0.3 volts and therefore the LSB DAC decoder 404 may be implemented using low voltage devices, which may be approximately ⅓ to ⅕ smaller than high power devices, thereby advantageously reducing the size of the column driver.

Figure 6:
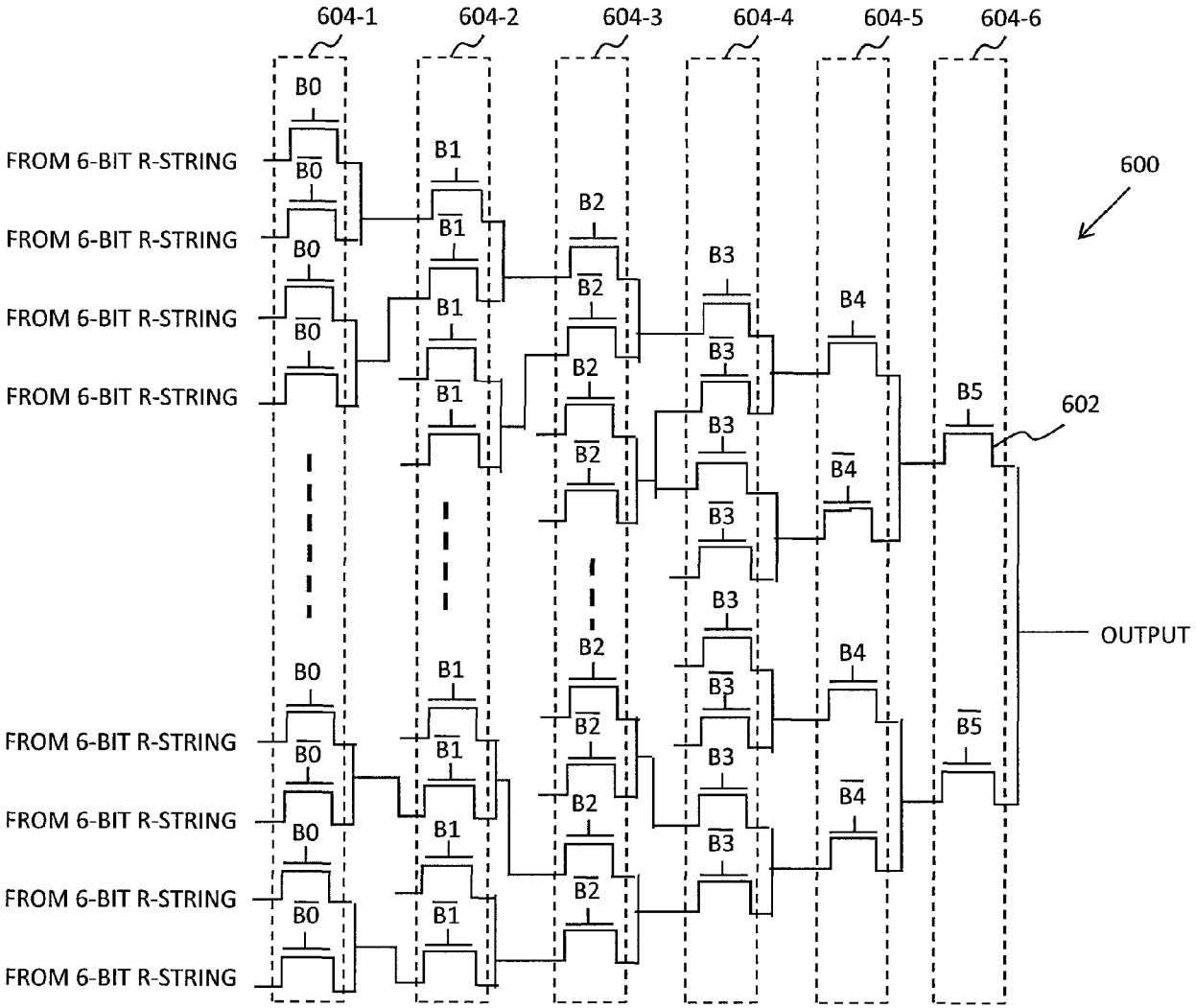
FIG. 6 illustrates one example of a DAC decoder in accordance with FIGS. 4A-5C.

FIG. 6 illustrates one example of a six-bit DAC decoder 600, which may be used as the MSB DAC decoder 402 or the LSB DAC decoder 404. As shown in FIG. 6, the decoder 600 includes a plurality of transistors 602 arranged in a plurality of columns 604-1, 604-2, 604-3, 604-4, 604-5, and 604-6 (collectively "columns 604") with each column having a decreasing number of transistors. For example, column 604-1 includes 64 transistors 602, column 604-2 includes 32 transistors, column 604-3 includes 16 transistors, column 604-4 includes 8 transistors, column 604-5 includes 4 transistors, and column 604-6 includes 2 transistors. One skilled in the art will understand that the number of columns as well as the number of transistors in each column may be varied depending on the number of bits the DAC decoder 600 decodes. Each transistor 602 in a column 602-1 is coupled to a conductive lead that provides a respective voltage level from the six-bit DAC. The output of each transistor 602 in each of the columns 604 is coupled to the output of another transistor 602 in the same column. The outputs from one column e.g., column 604-1, are used as the inputs for the transistors in next column, e.g., column 604-2.

The turning on and off of each of the transistors 602 in a column is controlled by the same bit of the multi-bit digital input code. For example, the turning on and off of the two transistors 602 in column 604-6 are oppositely controlled by the sixth most significant bit, e.g., bit B5, of the multi-bit digital input code with one transistor receiving the bit B5 and the other transistor receives the logical inverse of the bit B5, e.g., $\overline{B5}$. Accordingly, if bit B5 is a logic '1' than one of the transistors in column 604-6 would be turned on as it receives a logic '1' at its gate, and the other transistor would be turned off as it receives a logic '0' at its gate. In the remaining columns, e.g., columns 604-1, 604-2, 604-3, 604-4, and 604-5, each pair of transistors having their outputs coupled together may be controlled in the similar fashion to the transistor pair in column 604-6. In this manner, the DAC decoder 600 decodes a digital input code and outputs a voltage level in response.

Referring again to FIG. 4A, switches 408 and 410 are alternately opened and closed during sequential image frames. For example, during a first phase, $\phi$1, of a two phase cycle that may include two image frames, switch 408 is closed and switch 410 is open. Thus, during $\phi$1, the output of the MSB DAC decoder 402 is coupled to the input of the buffer 406, which outputs the signal to the LCD column. During $\phi$2, switch 408 is open and switch 410 is closed resulting in the output of the LSB DAC decoder 404 being output to the LCD column through the buffer 406. The control signals to open and close switches 408, 210 are generated from the frame control signals, which are not shown to simplify the figure.

For example, if 60 frames are shown per second (e.g., frames 0-59), then switch 408 would be closed for 30 frames (e.g., frames 0, 2, 4, 6, . . . , 58) and switch 410 would be closed for 30 frames (e.g., frames 1, 3, 5, . . . , 59). Thus, the voltage level identified by the MSBs of the multi-bit input code will be output to the LCD column when switch 408 is closed, and the voltage level identified by the LSBs of the multi-bit input code will be output when switch 410 is closed thereby time averaging the voltage output of the MSBs and the LSBs of the multi-bit input code. Consequently, the time averaging of the voltages output to the LCD column may result in a reduction in the brightness of the LCD column as the total voltage level is divided between two sequential frames.

For example, the brightness, BR, of an image displayed on an LCD perceived by a human eye is based on the intensity of the light, L, times the length of time, T, which the frame is displayed. The intensity of light transmitted by an LCD display is based on the voltage applied to the pixels and thus the intensity is voltage dependent, L(v). Accordingly, the brightness of a frame is reduced if the voltage is time averaged. For a ten-bit digital input code, the brightness, BR, may be approximated by the following equation:

$$BR = L(v - msb)\left(\frac{T}{2}\right) + L(v - lsb)\left(\frac{T}{2}\right) = [L(v - msb) + L(v - lsb)]\left(\frac{T}{2}\right) \cong L(v - all)\left(\frac{T}{2}\right)$$

Figure 4B:
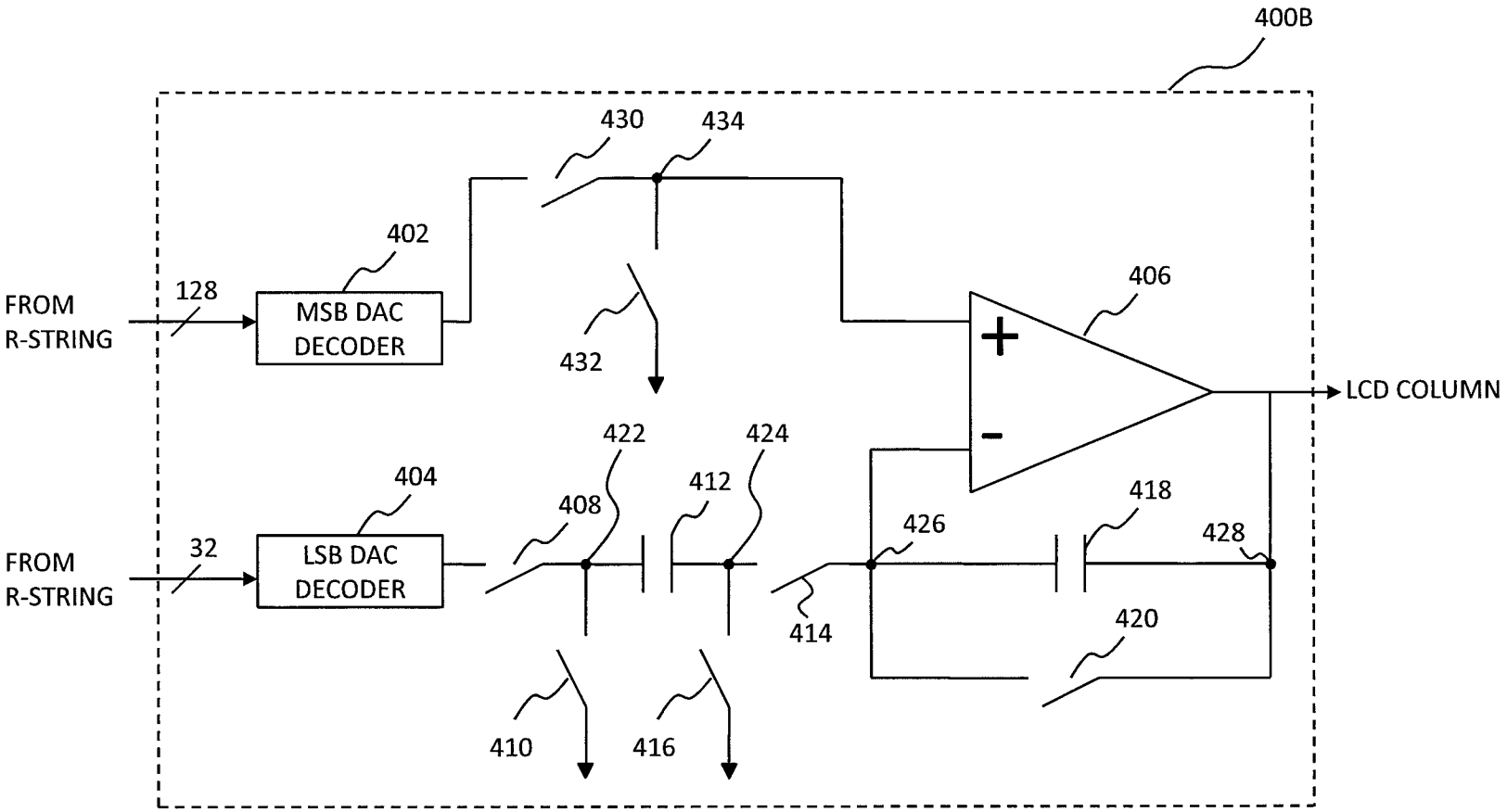
FIG. 4B illustrates another example of DAC decoder and summing circuitry in accordance with FIG. 3.

FIG. 4B illustrates another example of DAC decoder and summing circuitry 400B for compensating for the reduced brightness level. As shown in FIG. 4B, the DAC decoder and summing circuitry 400B includes an MSB DAC decoder 402, an LSB DAC decoder 404, and an opamp 406. The output of the MSB DAC decoder 402 is coupled to a node 434 through switch 430. Node 434 is also coupled to ground through switch 432 and to the positive terminal of the opamp 406. The output of LSB DAC decoder 404 is coupled to node 422 through switch 408. Switch 410 and input capacitor 412 are also coupled to node 422, with switch 410 also being coupled to ground. Input capacitor 412 is coupled to node 424 along with switches 414 and 416 with switch 416 also being coupled to ground. Switch 414 is coupled to node 426 as is the negative terminal of opamp 406, an output capacitor 418, and switch 420. Output capacitor 418 and switch 420 are coupled in parallel at node 428 to the output of the opamp 406.

Switches 408, 414, and 432 open and close together as do switches 410, 416, 420, and 430, but switches 408, 414, and 432 will not be open when switches 410, 416, 420, and 430 are open and vice versa. For example, switches 408, 414, and 432 may be open during a first phase, ϕ1, of a two phase cycle and be closed during the second phase, ϕ2, of the cycle. With switches 408, 414, and 432 open during ϕ1, opamp 406 acts as a unity gain buffer and outputs the output of the MSB DAC decoder 402 to the LCD column. During ϕ2, switches 408, 414, and 432 close and switches 410, 416, 420, and 430 open resulting in the output of the LSB DAC decoder 404 being output through the input and output capacitors 408 and 418 to the LCD column.

Further brightness enhancement may be achieved by varying the number of frames, n, in a cycle as well as the number of frames per cycle the output of the MSB DAC decoder 402 is output to the LCD column. In some embodiments the two phase cycle may be four frames in duration, e.g., n=4, with each phase of the four-frame cycle corresponding to a subset of frames. For example, the cycle may have a duration of four frames and the first phase, ϕ1, may have a duration of three frames, e.g., frames 1 to n−1 (frames 1-3), and the second phase, ϕ2, may have the remaining duration of the cycle, e.g., frame 4. The brightness output by the LCD display is effectively dominated by the MSB since these bits correspond to the greater voltage levels. Accordingly, by outputting the output of the MSB DAC decoder 402 for three out of four frames using DAC decoder and summing circuitry 400B, then the brightness output from the LCD display will be increased, e.g., by 25 percent, compared to an LCD display having DAC decoder and summing circuitry 400A illustrated in FIG. 4A.

The voltage output of the LSB DAC decoder 404 may be amplified by sizing the output capacitor 418 to be smaller than the input capacitor 412, which is a switched capacitor to compensate for the output of the MSB DAC decoder 402 being output with more frames than the output of the LSB DAC decoder 404. For example, if a cycle consists of four frames and the output of the MSB DAC decoder 402 is output to the LCD column in three frames and the output of the LSB DAC decoder 404 is output to the LCD column once, then gain may be set at three by sizing input capacitor 412 approximately three times the size of output capacitor 418 in the switched capacitor amplifier arrangement shown in FIG. 4B. Increasing the gain based on the number of times a frame is output in a cycle using the output of the MSB DAC decoder 402 compared to the output of the LSB DAC decoder 404 compensates for the output of the LSB DAC decoder 404 being output in fewer frames than the output of the MSB DAC decoder 402.

Figure 5A:
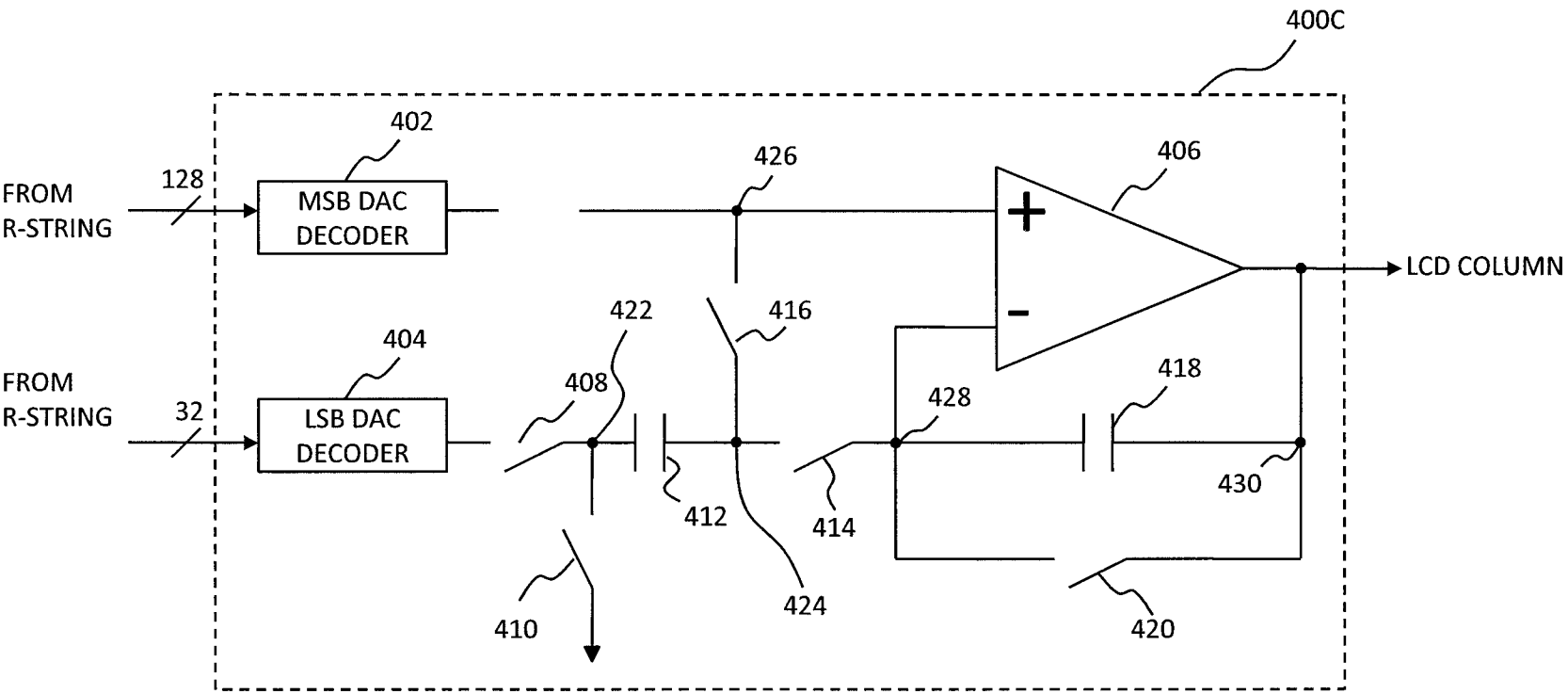
FIG. 5A illustrates another example of DAC decoder and summing circuitry in accordance with FIG. 3.

FIG. 5A illustrates another example of DAC decoder and summing circuitry 400C. As shown in FIG. 5A, the DAC decoder and summing circuitry 400C includes an MSB DAC decoder 402 coupled to a positive input of an opamp 406, and an LSB DAC decoder 404 having an output coupled to an input capacitor 412 through switch 408 at node 422. Input capacitor 412 is coupled between switches 408 and 414 at nodes 422 and 424, respectively. A switch 410 is coupled between ground and node 422, and a switch 414 is coupled between node 428 and node 426, which is coupled to the output of MSB DAC decoder 402 and the positive terminal of opamp 406. Switch 414 is coupled to the negative terminal of opamp 406, to output capacitor 418, and to switch 420 at node 428. Output capacitor 418 and switch 420 are coupled together in parallel and to the output of opamp 406 at node 430.

Figure 5B:
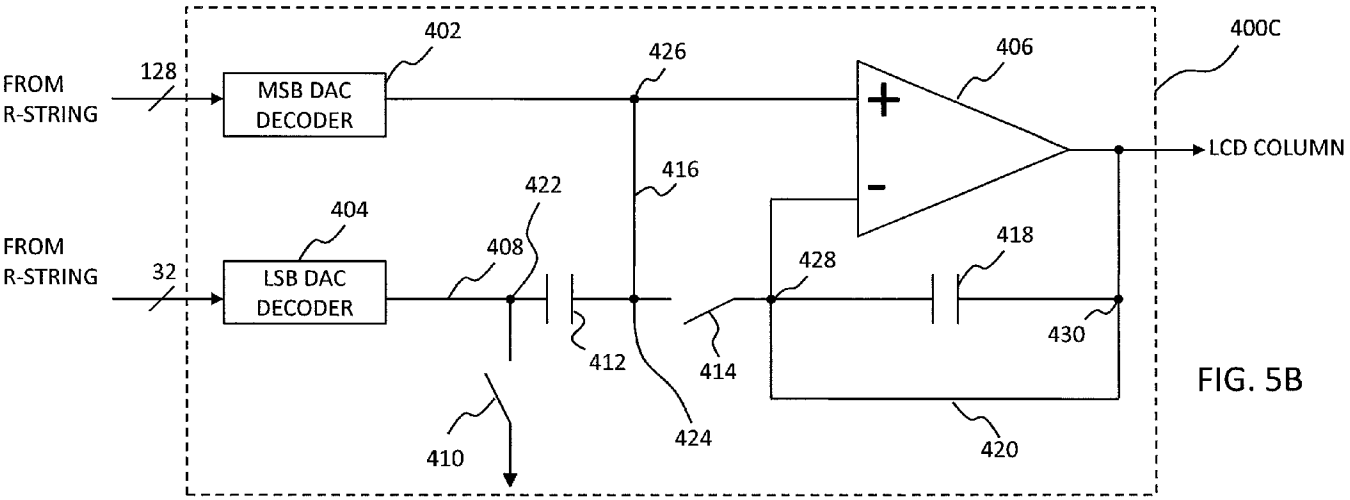
FIG. 5B illustrates the DAC decoder and summing circuitry illustrated in FIG. 5A during a first phase of a two phase cycle.

In operation, switches 408, 416, and 420 open and close together, and switches 410 and 414 open and close together, but switches 408, 416, and 420 are not open at the same time switches 410 and 414 are open, and vice versa. For example, FIG. 5B illustrates the time-average DAC decoder and summing circuit 400C in a first phase, ϕ1, of a two phase cycle. As shown in FIG. 5B, during ϕ1, switches 408, 416, and 420 are in the closed position and switches 410 and 414 are in the open position. With switches 410 and 414 open, charge from the LSB DAC decoder 404 develops on input capacitor 412 until the potential difference across capacitor 412 is equal to the output of the LSB DAC decoder 404. Also during ϕ1, opamp 406 acts as a unity gain buffer outputting the output of MSB DAC decoder 402 to the LCD column.

Figure 5C:
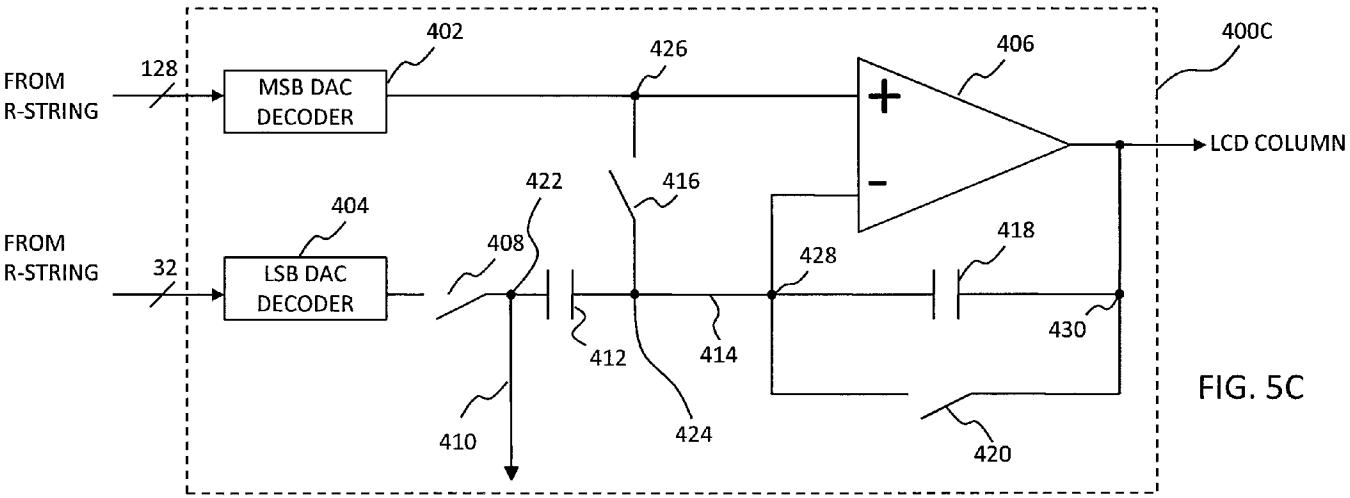
FIG. 5C illustrates the DAC decoder and summing circuitry illustrated in FIG. 5A during a second phase of a two phase cycle.

FIG. 5C illustrates the time-average DAC decoder and summing circuitry 400C during ϕ2. As shown in FIG. 5C, switches 410 and 414 are closed, and switches 408, 416, and 420 are open. With switches 408 and 416 open, the input capacitor 412 discharges, which in turn charges the output capacitor 418. The charge stored on output capacitor 418 is equal to the output of the LSB DAC decoder 404 relative to the output of MSB DAC decoder 402 since the output of MSB DAC decoder 402 is coupled the positive terminal of opamp 406 and switch 416 being open during ϕ2. Accordingly, the outputs of the MSB and LSB DAC decoders 402 and 404 are summed together through opamp 406.

Although embodiments are described above as receiving a ten-bit digital input code, one skilled in the art will understand that the digital input code may have fewer or more bits. Additionally, the number of bits the MSB DAC decoders and LSB DAC decoders may be configured to decode may also be varied. For example, the MSB and LSB DAC decoders may be configured to decode an equal number of bits. Equally dividing the digital input code into an equal number of MSBs and LSBs provides a further reduction in the number of lines needed to connect the DAC decoders to the DACs. Using a ten-bit digital input code as an example, each PDAC decoder would receive 32 different voltage levels each on 32 respective lines, and each NDAC decoder would also receive 32 different voltage levels on 32 respective lines. Accordingly, 128 total lines would connect each of the positive and negative MSB and LSB DAC decoders to the positive and negative DACs. In another example using a ten-bit input code, the MSB DAC decoder may be configured to decode seven, eight, or nine bits and the LSB DAC may accordingly be configured to decode three, two, or one bit, with the number of lines for coupling the MSB DAC being incrementally increased for each additional bit being decoded by the MSB DAC decoder.

The improved LCD driver architecture described above advantageously reduces the number of lines needed to connect the DAC decoders to the common DACs while at the same time maintaining full resolution and brightness of the display. Using common DACs for each channel of the LCD panel reduces channel mismatch that may be present in conventional methods such as those set forth in the Lu et al. reference as each channel has common voltage references. Additionally, the improved LCD architecture enables some DAC decoders to be implemented using low power devices that have a ⅓ to ⅕ smaller size compared to the high-power devices required in conventional designs.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A circuit, comprising:

a first digital-to-analog converter (DAC) decoder circuit having a first plurality of inputs, each of the first plurality of inputs coupled to a respective output of a first DAC, the first DAC decoder circuit configured to receive a first number of bits of a digital control signal and output a first output signal in response thereto, the first output signal having a first voltage level corresponding to a voltage level received at one of the first plurality of inputs;

a second DAC decoder circuit having a second plurality of inputs, each of the second plurality of inputs coupled to a respective output of a second DAC, the second DAC decoder circuit configured to receive a second number of bits of the digital control signal and output a second output signal in response thereto, the second output signal having a second voltage level corresponding to a voltage level received at one of the second plurality of inputs; and a switched capacitor summing circuit configured to be selectively coupled to the output from the first DAC decoder circuit during a first phase of a cycle and to the output of the second DAC decoder circuit during a second phase of the cycle, the switched capacitor summing circuit configured to output a third output signal having a voltage level based on one of the first and second voltage levels received from the outputs of the first and second DAC decoder circuits, wherein a length of the cycle corresponds to a first number of frames with each frame having a respective duration, the first phase of the cycle corresponds to a second number of frames that is greater than one, and the second phase of the cycle corresponds to a third number of frames that is less than the first and second numbers of frames.

2. The circuit of claim 1, wherein the switched capacitor summing circuit includes an operational amplifier having first and second inputs, the first input of the operational amplifier configured to receive the output of the first DAC decoder circuit, the second input of the operational amplifier configured to receive the output of the second DAC decoder circuit.

3. The circuit of claim 1, wherein the switched capacitor summing circuit includes an operational amplifier, a first switch disposed between the output of the first DAC decoder circuit and a first node coupled to an input of the operational amplifier; and a second switch disposed between the output of the second DAC decoder circuit and the first node, wherein the first and second switches are configured to alternately open and close to alternately couple and decouple either one of the first and second DAC decoder circuits to the buffer.

4. The circuit of claim 1, wherein the switched capacitor summing circuit includes:

a switched capacitor coupled between the output of the second DAC decoder circuit and the second input of the operational amplifier; and a second capacitor and a switch coupled together in parallel across the second input and an output of the operational amplifier.

5. The circuit of claim 4, wherein the switched capacitor includes:

a second switch coupled to the output of the second DAC decoder circuit and the switched capacitor, a third switch coupled to ground and to a node between the second switch and the switched capacitor, a fourth switch coupled to the switched capacitor and to the second input of the operational amplifier, and a fifth switch coupled to a node between the output of the first DAC decoder circuit and the first input of the operational amplifier and to a node between the switched capacitor and the fourth switch.

6. The circuit of claim 5, wherein a first group of switches including the first, second, and fifth switches are configured to open and close together, and wherein a second group of switches including the third and fourth switches are configured to open and close together.

7. The circuit of claim 6, wherein the first group of switches are configured to be open and the second group of switches are configured to be closed during the first phase of the cycle, and wherein the first group of switches are configured to be closed and the second group of switches are configured to be open during the second phase of the cycle.

8. The circuit of claim 1, wherein the switched capacitor amplifier includes:

a first switch coupled to the output of the second DAC decoder circuit and to the switched capacitor;

a second switch coupled to ground and to a node between the first switch and the switched capacitor;

a third switch coupled to the switched capacitor and to the second input of the operational amplifier;

a fourth switch coupled to ground and to a node between the switched capacitor and the third switch; and a second capacitor and a fifth switch coupled together in parallel across the second input and an output of the operational amplifier.

9. The circuit of claim 8, wherein a first group of switches including the first and third switches are configured to open and close together during the first phase of the cycle, and wherein a second group of switches including the second, fourth, and fifth switches are configured to open and close together during the second phase of the cycle.

10. The circuit of claim 1, wherein the first number of bits is greater than the second number of bits.

11. The circuit of claim 1, wherein the third output signal is output to an LCD column.

12. The circuit of claim 1, wherein an output capacitor of the second DAC decoder is smaller than an input capacitor of the second DAC decoder.

13. A method, comprising:

outputting a first signal from a first digital-to-analog converter (DAC) decoder circuit in response to receiving a first number of bits of a digital control signal, the first signal having a voltage level equal to one of a first plurality of voltage levels received at one of a first plurality of inputs of the first DAC decoder circuit;

outputting a second signal from a second DAC decoder circuit in response to receiving a second number of bits of the digital control signal, the second signal having a voltage level equal to one of a second plurality of voltage levels received at one of a second plurality of inputs of the second DAC decoder circuit; and selectively outputting the voltage of the first signal during a first phase of a cycle and the voltage of the second signal during a second phase of the cycle to an LCD column from a switched capacitor summing circuit that is coupled to the first and second DAC decoder circuits, wherein a length of the cycle corresponds to a first number of frames with each frame having a respective duration, the first phase of the cycle corresponds to a second number of frames that is greater than one, and the second phase of the cycle corresponds to a third number of frames that is less than the first and second numbers of frames.

14. The method of claim 13, further comprising:

dividing the digital control signal into the first number of bits and the second number of bits, wherein the first number of bits correspond to most significant bits of the digital control signal, and wherein the second number of bits correspond to least significant bits of the digital control signal.

15. The method of claim 13, wherein the first number of bits is greater than or equal to the second number of bits.

16. The method of claim 13, further comprising:

amplifying the voltage level of the second signal prior to outputting the second signal to the LCD column.

* * * * *